US012570388B1

(12) United States Patent
Marohl et al.

(10) Patent No.: US 12,570,388 B1
(45) Date of Patent: Mar. 10, 2026

(54) BOW THRUSTER MODULE AND RELATED METHODS

(71) Applicant: Correct Craft IP Holdings, LLC, Orlando, FL (US)

(72) Inventors: Aaron M. Marohl, Saint Cloud, FL (US); Eric J. Miller, Orlando, FL (US); Adam C. Greer, Orlando, FL (US); Mark C. McKinney, Chapin, SC (US)

(73) Assignee: CORRECT CRAFT IP HOLDINGS, LLC, Orlando, FL (US)

( * ) Notice: Subject to any disclaimer, the term of this patent is extended or adjusted under 35 U.S.C. 154(b) by 686 days.

(21) Appl. No.: 17/964,001

(22) Filed: Oct. 11, 2022

Related U.S. Application Data

(60) Provisional application No. 63/254,183, filed on Oct. 11, 2021.

(51) Int. Cl.
*B63H 5/14* (2006.01)
*B63B 3/38* (2006.01)
*B63H 25/42* (2006.01)

(52) U.S. Cl.
CPC ..... *B63H 25/42* (2013.01); *B63H 5/14* (2013.01); *B63B 3/38* (2013.01)

(58) Field of Classification Search
CPC ..... B63H 25/42; B63H 5/14; B63B 3/38
See application file for complete search history.

(56) References Cited

U.S. PATENT DOCUMENTS

| | | | | |
|---|---|---|---|---|
| 7,765,946 | B1 * | 8/2010 | Berman | B63H 25/46 114/151 |
| 8,584,609 | B2 * | 11/2013 | Stasolla | B63H 25/42 114/151 |
| 2022/0348300 | A1 * | 11/2022 | Weber | B63H 25/46 |
| 2024/0208631 | A1 * | 6/2024 | Railey | B63H 25/46 |

* cited by examiner

*Primary Examiner* — Anthony D Wiest
(74) *Attorney, Agent, or Firm* — Allen, Dyer, Doppelt + Gilchrist, PA

(57) ABSTRACT

A watercraft comprises a fiberglass hull and a bow thruster module. The fiberglass hull has a keel and a bow, a recess being formed in the hull extending into the keel proximate to the bow. The bow thruster module is mounted in the recess and includes a housing at least partially defining an athwartships tunnel and a propeller mounted in the tunnel, the housing including a fairing generally continuing a profile of the keel and surrounding hull around the recess.

20 Claims, 5 Drawing Sheets

BOW THRUSTER MODULE AND RELATED METHODS

CROSS-REFERENCE TO RELATED APPLICATION

This application claims the benefit of U.S. Provisional Patent Application Ser. No. 63/254,183 filed on Oct. 11, 2021, the contents of which are herein incorporated by reference in their entirety.

FIELD OF THE INVENTION

The present invention relates to bow thrusters, and more particularly, to the integration of a bow thruster into the bow section of a watercraft hull.

BACKGROUND OF THE INVENTION

Bow thrusters are widely used on watercraft to improve maneuverability, particularly when docking or undocking, or otherwise maneuvering in close quarters. A common bow thruster mounting features the thruster propeller mounted in a tunnel extending athwartships through the hull near the bow. Except for the sealed opening needed to accommodate propeller driveshaft, the tunnel is only open on the opposite ends and the interior of the tunnel continues the watertight integrity of the hull.

Many watercraft feature hulls that are molded as a single piece, which, in addition to ease of manufacturer, imparts desirable strength and watertightness characteristics to the hull. Normal whole-hull molding methods, however, do not readily accommodate the formation of an internal tunnel. In the case of molded fiberglass hulls, for instance, the inclusion of a bow tunnel would normally require cutting holes in opposite sides of the molded hull and connecting a separately formed tunnel therebetween. This process requires time consuming and highly skilled labor to seamlessly integrate the tunnel with the rest of the hull.

U.S. Pat. No. 7,765,946, issued Aug. 3, 2010, attempts to address this problem by molding only the upper section of the tunnel integrally with the hull. A "keystone insert," which complements the shape of the molded upper section is then connected to complete the tunnel. While this does not require cutting through a watertight portion of the hull, it requires extensive skilled labor to manufacture the keystone insert, as well as to integrate the keystone insert with the surrounding hull to create the complete tunnel.

SUMMARY OF THE INVENTION

In view of the foregoing, it is an object of the present invention to provide a bow thruster module and related methods. According to an embodiment of the present invention, a watercraft comprises a fiberglass hull and a bow thruster module. The fiberglass hull has a keel and a bow, a recess being formed in the hull extending into the keel proximate to the bow. The bow thruster module is mounted in the recess and includes a housing at least partially defining an athwartships tunnel and a propeller mounted in the tunnel, the housing including a fairing generally continuing a profile of the keel and surrounding hull around the recess.

According to an aspect of the present invention, the recess includes an upper surface co-molded with the surrounding hull. According to another aspect, the recess is open and the housing closes the recess. According to an additional aspect, an electric drive is located in the housing along with the propeller, such that only power cables penetrate the hull. According to a further aspect, the housing includes a first section which is connected to the close the recess and a second section releasably connected to the first section. Removal of the second section gives access to the propeller and/or drive without requiring removal of the first section.

According to a method aspect, a method of mounting a bow thruster to a watercraft includes forming a fiberglass hull will a recess extending into the keel proximate to the bow, and connecting a bow thruster module to the hull within the recess such that a fairing of the bow thruster module continues a profile of the keel and surrounding hull around the recess.

These and other objects, aspects and advantages of the present invention will be better appreciated in view of the drawings and following detailed description of preferred embodiments.

DETAILED DESCRIPTION OF PREFERRED EMBODIMENTS

Figure 1:
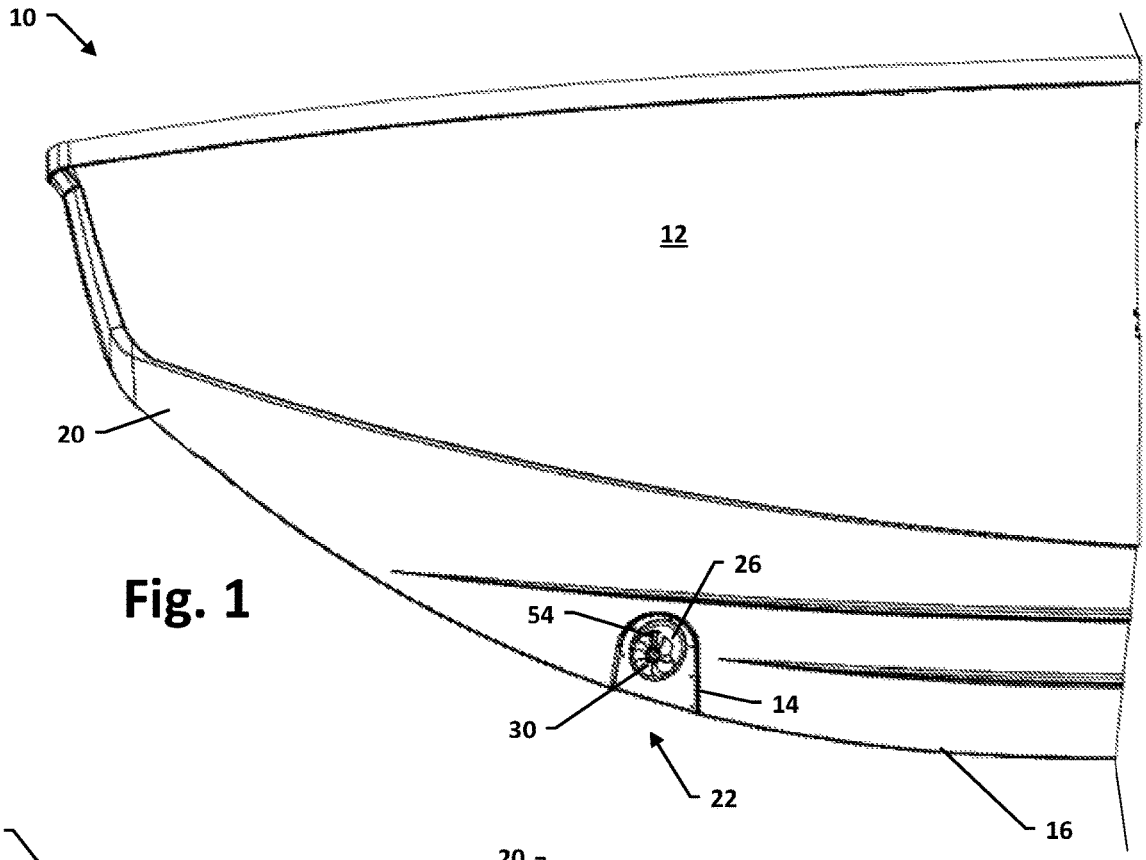
FIG. 1 is a side view of a forward portion of a watercraft including a bow thruster module, according to an embodiment of the present invention.
Figure 2:
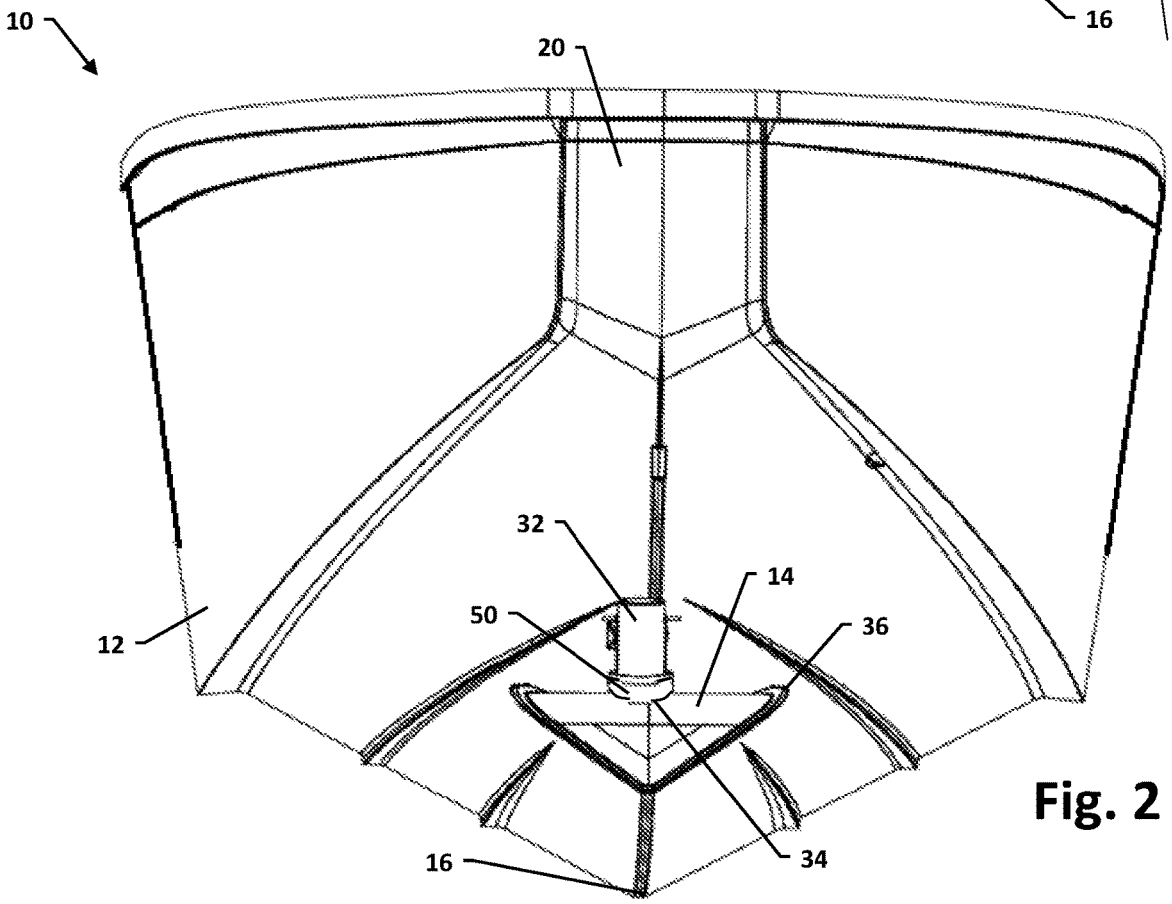
FIG. 2 is a read interior view of the forward portion of the watercraft of FIG. 1.
Figure 3:
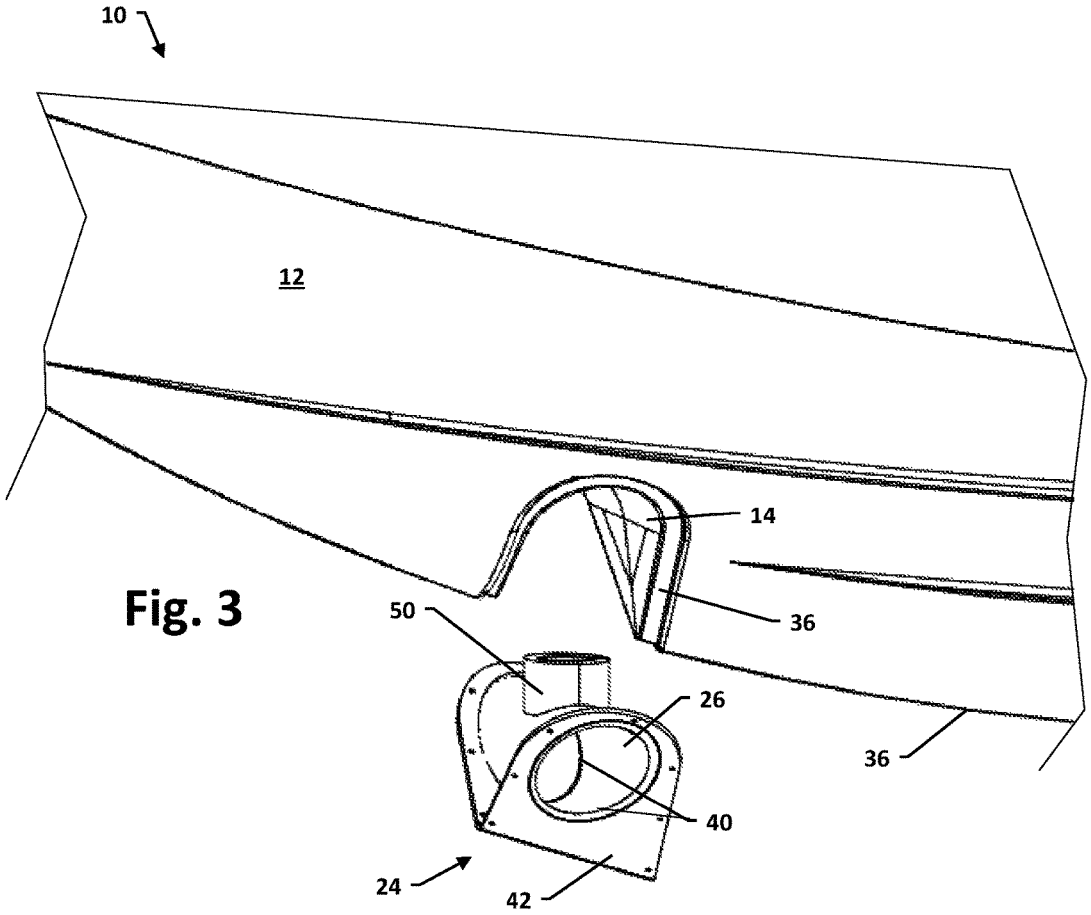
FIG. 3 is a partially exploded perspective view of the forward portion of the watercraft of FIG. 1.

Referring to FIGS. 1-3, according to an embodiment of the present invention, a watercraft 10 has a hull 12 with a recess 14 molded in the keel 16 thereof proximate the bow 20. A bow thruster module 22 is located in the recess 14 and includes a housing 24 mounted to the recess 14 and completely defining an athwartships tunnel 26. The bow thruster module 22 further includes a propeller 30 mounted in the tunnel 26 that is operable via a drive 32 to impart port or starboard thrust to the bow 20. For the purposes of the present application, the recess is "proximate" the bow of the hull if it is closer to the bow than to the stern.

The hull 12 is preferably fiberglass and the recess 14 is advantageously co-molded therewith. A housing passage 34 is defined in an upper surface of the recess 14. A step 36 is inset from the surrounding hull 12 around a periphery of the recess 14 and is also co-molded with the hull. In the depicted embodiment, the recess 14 is generally curved; however, this is not a requirement as the recess 14 does not form any part of the tunnel 26 and need not be conformal thereto. As will be seen below, the recess can also be "open" in some embodiments, meaning that is completely penetrates the hull.

Figure 4:
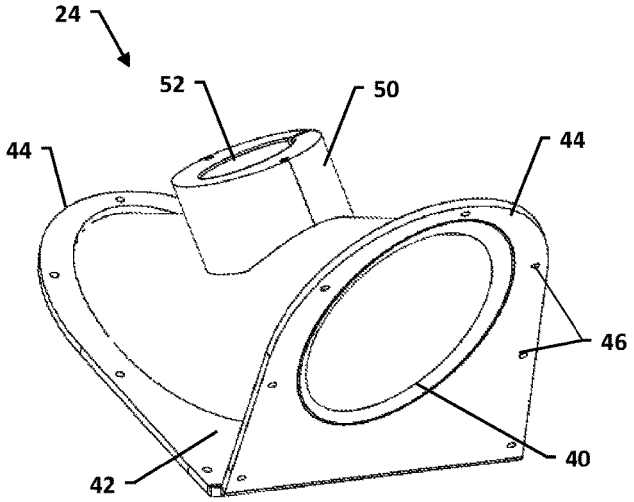
FIGS. 4 and 5 are perspective views of a housing of the bow thruster module of FIG. 1.
Figure 5:
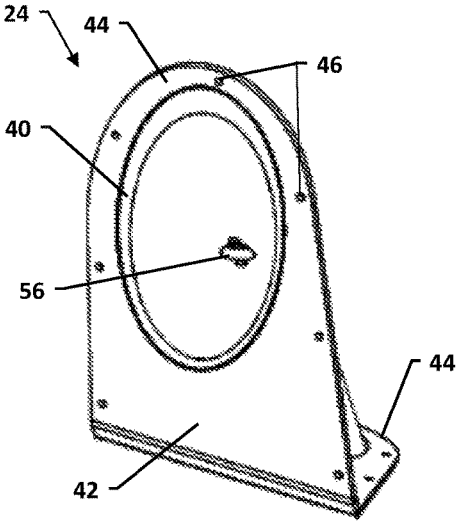

Referring also to FIGS. 4 and 5, the housing 24 includes the tunnel 26 which extends between opposite openings 40 in an exterior fairing 42. The exterior fairing 42 is configured so as to generally continue the profile of the keel 16 and surrounding hull 12 in the area of the recess 14 and so that outer edges 44 of the fairing 42 will overlie the step 36 around the periphery of the recess 14. Fastener holes 46 are located around the outer edges 44. The fairing "generally" continues the profile of the keel and surrounding hull if it matches the forward-to-aft line thereof and is either flush therewith or recessed therefrom.

A housing neck 50 extends upwardly from an upper surface of the tunnel 26 through the housing passage 34. The drive 32 is mounted to the neck 50 inside the hull 12 over an upper opening 52. A drive shaft 54 for the propeller 30 extends through the neck 50 into the tunnel 26 through a lower opening 56. The housing is preferably fabricated from aluminum, stainless steel or other suitable metal.

The bow thruster module 22 is installed by simply inserting the housing 22 into the recess 14 with the neck 50 extending through the housing passage 34. The housing 22 is secured in place by fasteners inserted through the holes 46 into the step 36. Depending on the dimensions of the drive 32 and manufacturer preference, the drive 32 and propeller 34 can be attached to the housing 22 before or after connection of the housing 22 within the recess 14.

It will be appreciated that a bow thruster module according to the present invention can be quickly and easily installed, particularly in fiberglass hulls, while requiring no additional time and effort to carefully fit complementary elements together. Removal of the bow thruster module for maintenance or replacement is also greatly facilitated.

In the following description of alternate embodiments and in the corresponding Figures, like components will be labeled with like reference numbers prefaced with a different number (e.g., watercraft 10, watercraft 110, watercraft 210). Except as specifically described, like-numbered components will be understood to have substantially the same function as described above.

Figure 6:
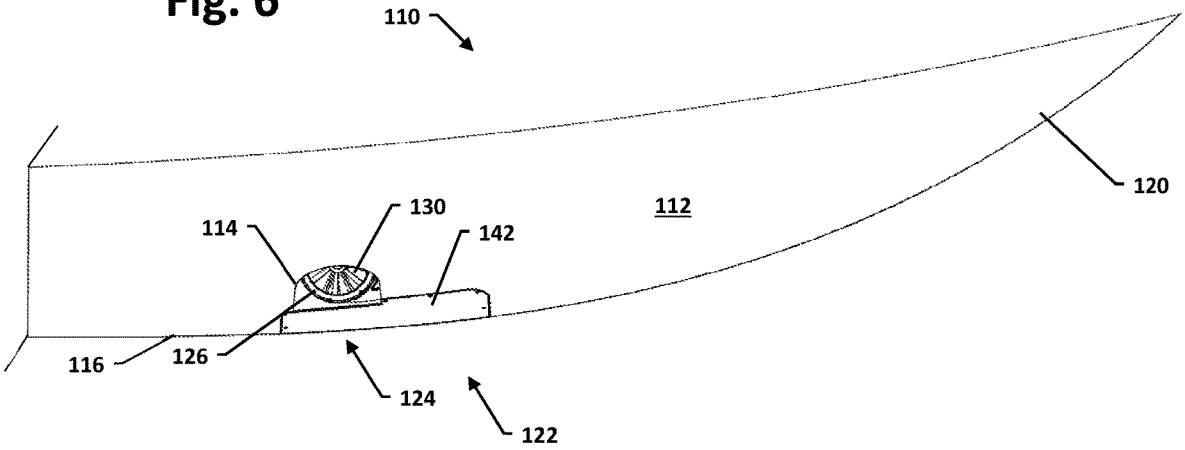
FIG. 6 is side view of a forward portion of a watercraft including a bow thruster module, according to another embodiment of the present invention.
Figure 7:
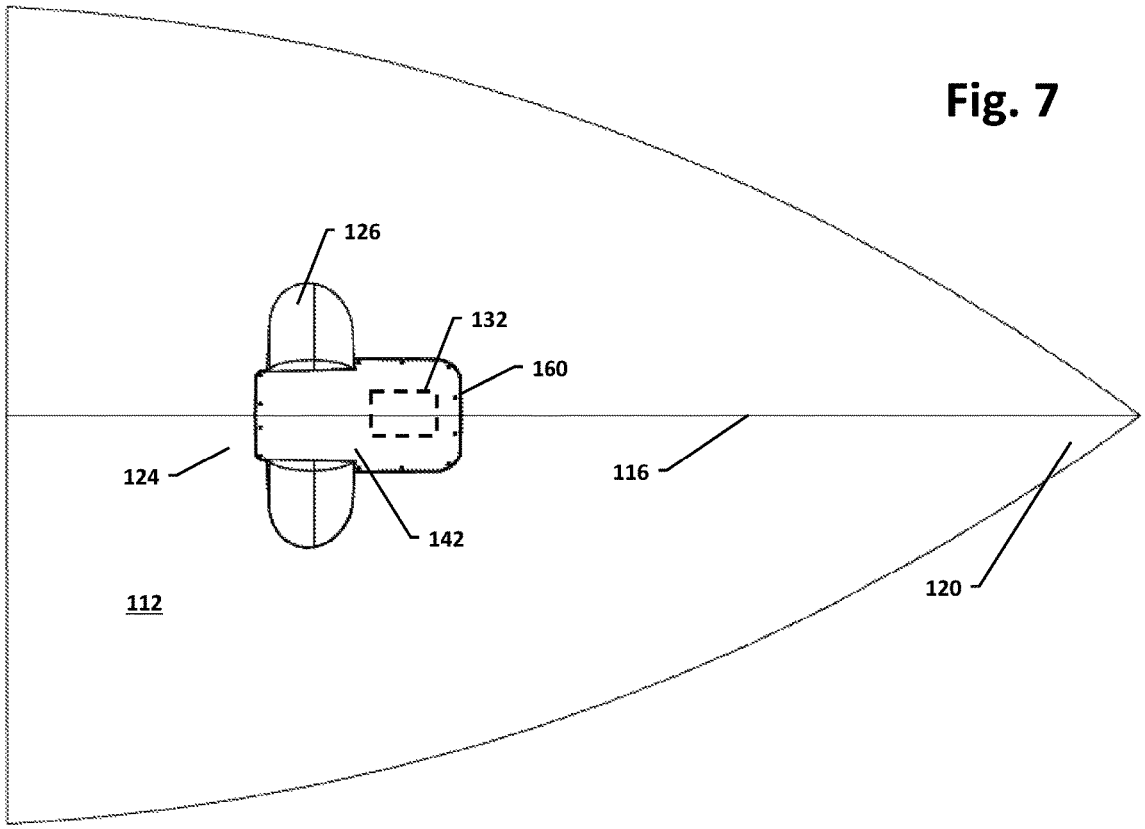
FIG. 7 is a bottom view of the forward portion of the watercraft and bow thruster module of claim 7.

Referring to FIGS. 6 and 7, according to another embodiment of the present invention, a watercraft 110 has a hull 112 with a recess 114 molded in the keel 116 thereof proximate the bow 120. A bow thruster module 122 is located in the recess 114 and includes a housing 124 mounted to the recess 114 and partially defining an athwartships tunnel 126 with an upper surface of the recess 114 also partially defining the tunnel 126. The bow thruster module 122 further includes a propeller 130 mounted in the tunnel 126 that is operable via a drive 132 to impart port or starboard thrust to the bow 120. The housing 124 also includes a fairing 142 configured so as to generally continue the profile of the keel 116 and surrounding hull 112.

In the watercraft 110, the recess 114 includes a forward portion 160 located forwardly of the tunnel 126, which allows the drive 132 (schematically depicted in broken lines to also be mounted within the housing 124. The drive 132, which preferably incorporates a sealed electric motor, is thus located outside the watertight hull envelope and only power/control cabling penetrates the hull to connect to the drive 132.

Figure 8:
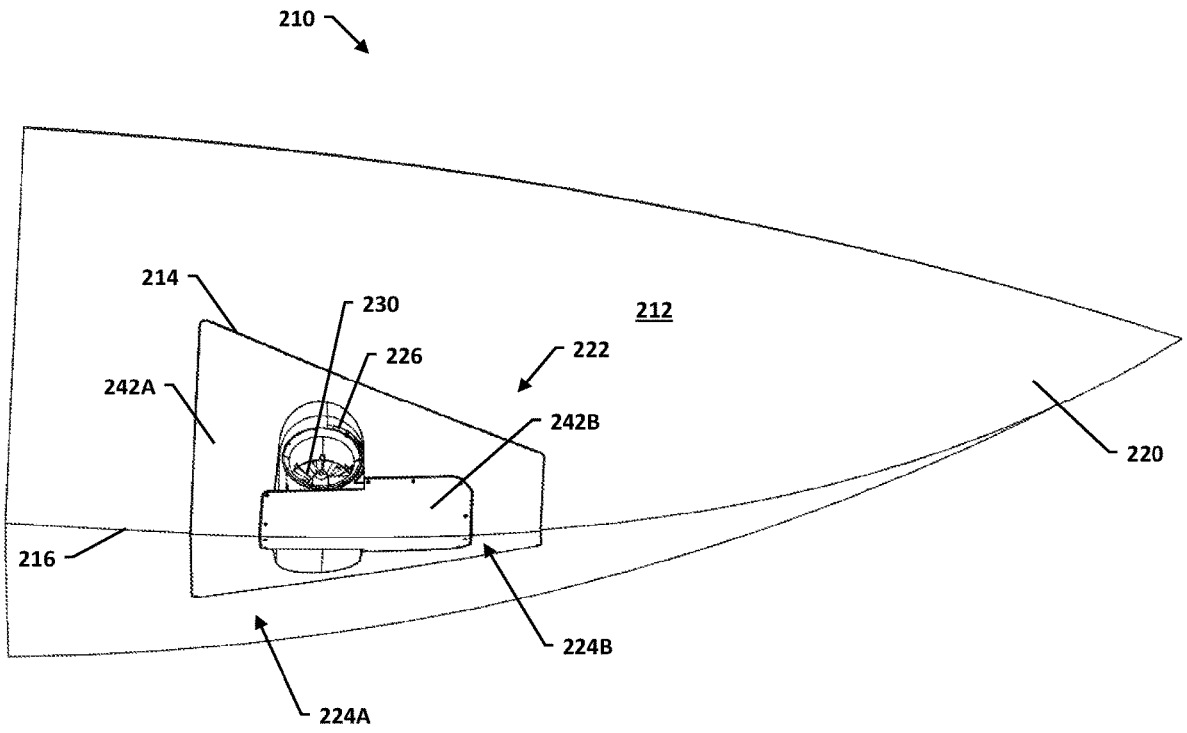
FIG. 8 is a perspective view of a forward portion of a watercraft including a bow thruster module, according to a further embodiment of the present invention.
Figure 9:
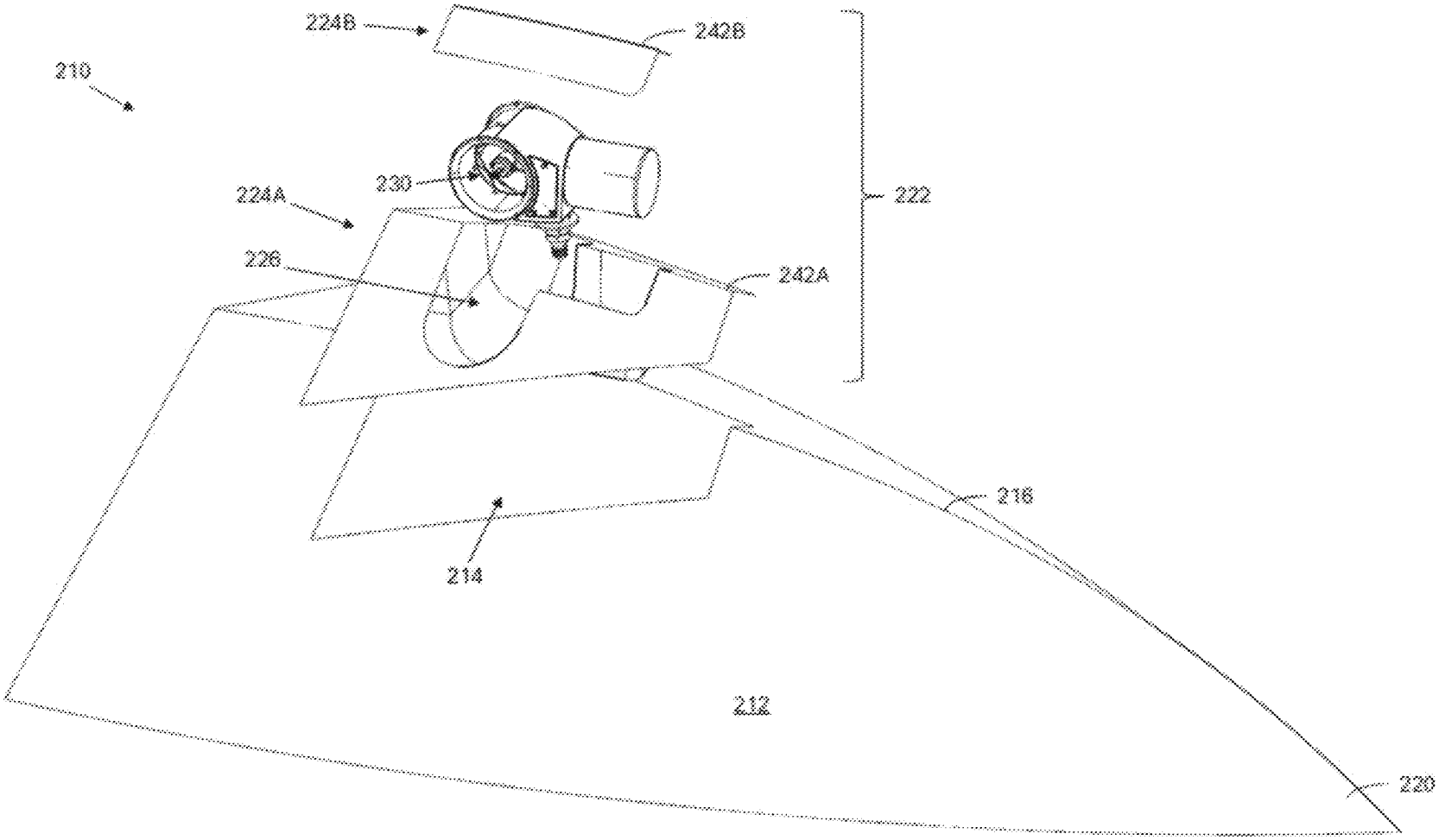
FIG. 9 is an inverted exploded view of the embodiment illustrated in FIG. 8.

In a further embodiment, referring to FIGS. 8 and 9, a watercraft 210 has a hull 212 with a recess 214 molded as an opening in the keel 216 thereof proximate the bow 220. A bow thruster module 222 is located in the recess 214 and includes first and second housing sections 224A, 224B. The first housing section 224A is mounted to the hull 212 sealing the recess 214, thereby forming part of the watertight hull envelop and also partially defining an athwartships tunnel 226. A propeller 230 is located within the tunnel 226.

The second housing section 224B is removably mounted to the first housing section 224A below the tunnel. The allows the first housing section 224B to be removed to access the propeller and/or drive for maintenance or replacement without penetrating the watertight hull envelop while allowing for a simpler fiberglass hull form. The first and second housing sections 224A, 224B include respective first and second fairing portions 242A, 242B configured so as to generally continue the profile of the keel 216 and surrounding hull 212.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described.

What is claimed is:

1. A watercraft comprising:

a fiberglass hull having a keel and a bow, a recess being formed in the hull extending into the keel proximate to the bow; and a bow thruster module mounted in the recess and including a housing at least partially defining an athwartships tunnel extending across the keel and a propeller mounted in the tunnel, the housing including a fairing generally continuing a profile of the keel and surrounding hull around the recess, a housing neck extending upwardly from the fairing, and a propeller driveshaft extending through the housing neck and coupled to the propeller.

2. The watercraft of claim 1, wherein the recess includes an upper surface co-molded with the surrounding hull.

3. The watercraft of claim 2, wherein the upper surface partially defines the athwartships tunnel.

4. The watercraft of claim 1, wherein the housing completely defines the athwartships tunnel.

5. The watercraft of claim 4, wherein the recess is open and the housing includes a first section mounted to the hull and at least partially defining the athwartships tunnel and closing the recess, and a second section removably mounted to the first section below the tunnel.

6. The watercraft of claim 5, wherein the first section and the second section both include portions of the fairing.

7. The watercraft of claim 1, wherein the housing is made of metal.

8. The watercraft of claim 1, wherein the housing further contains an electric drive operable to rotate the propeller.

9. The watercraft of claim 1, wherein a step is inset from the surrounding hull around a periphery of the recess, outer edges of the fairing overlying the step.

10. The watercraft of claim 9, wherein the step is co-molded with the surrounding hull.

11. The watercraft of claim 1, wherein the housing neck extends upwardly from the tunnel.

12. A method of mounting a bow thruster to a watercraft, the method comprising:

forming a fiberglass hull with a recess extending into the keel proximate to the bow; and connecting a bow thruster module to the hull within the recess including a housing at least partially defining an athwartships tunnel and a propeller mounted in the tunnel comprising, the housing including a fairing continuing a profile of the keel and surrounding hull around the recess, a housing neck extending upwardly from the fairing, and a propeller driveshaft extending through the housing neck and coupled to the propeller.

13. The method of claim 12, wherein forming the fiberglass hull with the recess includes co-molding an upper surface of the recess with the surrounding hull.

14. The method of claim 12, wherein connecting the bow thruster module to the hull includes:

connecting a first section of a housing of the bow thruster module to the hull to close the recess; and connecting a second section of the housing to the first section below the athwartships tunnel.

15. The method of claim 14, wherein the fairing is formed from portions of the first and second sections.

16. The method of claim 12, wherein connecting the bow thruster module to the hull further includes installing an electric drive operable to drive the propeller within the housing.

17. The method of claim 12, wherein forming the fiberglass hull with the recess includes co-molding an inset step around a periphery of the recess and connecting the bow thruster module to the hull includes connecting outer edges of the fairing to overlie the inset step.

18. A watercraft comprising:

a fiberglass hull having a keel and a bow, a recess being formed in the hull extending into the keel proximate to the bow; and a bow thruster module mounted in the recess and including a housing completely defining an athwartships tunnel extending across the keel and a propeller mounted in the tunnel, the housing including a fairing generally continuing a profile of the keel and surrounding hull around the recess, the bow thruster module operable to impart port or starboard thrust to the bow.

19. The watercraft of claim 18, wherein the recess includes an upper surface co-molded with the surrounding hull.

20. The watercraft of claim 18, wherein the housing further contains an electric drive operable to rotate the propeller.

* * * * *